US005203569A

United States Patent [19]

Rilling

[11] Patent Number: 5,203,569

[45] Date of Patent: Apr. 20, 1993

[54] GOLF STANCE TRAINER

[75] Inventor: John F. Rilling, Roswell, Ga.

[73] Assignee: Golf research Technology Corporation, Norcross, Ga.

[21] Appl. No.: 822,185

[22] Filed: Jan. 16, 1992

[51] Int. Cl.[5] ..... A63B 69/36

[52] U.S. Cl. ..... 273/187.2; 273/188 R; 128/782

[58] Field of Search ..... 273/183 B, 188 R, 188 A, 273/189 R, 189 A, 190 R, 190 A, 190 B, 190 C, 187.2; 128/781, 782

[56] References Cited

U.S. PATENT DOCUMENTS

| | | | |
|---|---|---|---|
| 1,571,140 | 1/1926 | O'Connor | 128/781 |
| 2,324,672 | 7/1943 | Bierman et al. | 128/781 |
| 3,079,152 | 2/1963 | Cushing | 273/183 B X |
| 3,138,388 | 6/1964 | Herold | 273/188 R X |
| 3,215,438 | 11/1965 | Sheldon et al. | 273/188 R |
| 3,767,204 | 10/1973 | Bryson | 273/188 R X |
| 4,659,084 | 4/1987 | Vuick | 273/183 B |
| 4,708,148 | 11/1987 | Olson | 128/781 |
| 4,760,851 | 8/1988 | Fraser et al. | 128/781 X |
| 5,092,601 | 3/1992 | Rilling | 273/187.2 |
| 5,125,663 | 6/1992 | Lurowist | 273/183 B |

*Primary Examiner*—George J. Marlo

*Attorney, Agent, or Firm*—Trexler, Bushnell, Giangiorgi & Blackstone, Ltd.

[57] ABSTRACT

A golf stance trainer for monitoring a golfer's stance during a golf swing comprises a superstructure having at least one of a sensor for monitoring buttock positioning, a sensor for monitoring hip positioning, and a sensor for monitoring leg positioning during a golf swing. The sensor is actuated in response to a pivotal movement of a member that engages the golfer's buttocks, hips or leg, and signals the golfer that the swing is improper. The buttocks engaging member pivots about a horizontal axis, and the hip and leg engaging members pivot about vertical axes.

16 Claims, 2 Drawing Sheets

GOLF STANCE TRAINER

BACKGROUND AND SUMMARY OF THE INVENTION

The present invention relates generally to a new golf stance trainer apparatus for monitoring a golfer's stance during a golf swing and for teaching a golfer to maintain an appropriate stance during such a swing.

Today, many golfers, amateur as well as professional, have a strong desire to improve their golf game. They purchase new golf clubs, gloves, golf balls, and the like, in an effort to gain an advantage over other golfers and to improve their scores. Often, however, these equipment changes do not produce a significant improvement in the golf game.

For the game of most golfers to improve, the golfer himself must be improved. Namely, the golfer must learn appropriate techniques to employ during different stages of his game. One very important technique for golfers to learn and to employ is a proper golf stance. By learning and employing a proper golf stance, a golfer can increase his accuracy and distance during all aspects of the game, thereby reducing the number of strokes needed to reach the green. Thus, utilization of a proper golf stance can lead to a significant reduction in golf scores, and to greater enjoyment of the game.

In an ideal golf stance, the golfer's spine is angled forward approximately thirty degrees from the vertical. The upper leg limbs are inclined rearwardly approximately twenty degrees from the vertical.

When the golfer is in this position, a vertical line passing approximately through the center of the triceps intersects a kneecap and a ball of the foot of the golfer. This stance forces the golfer's buttocks into a substantially sitting position, which should be assumed when the golfer addresses the ball, and should be maintained until the golfer executes his follow through after appropriately striking the ball.

If the golfer maintains the above-described stance throughout his golf swing, he can experience greater accuracy and distance in his shots. These improvements can substantially reduce his golf score, and increase his enjoyment of the game. The golf stance trainer of the present invention is intended to teach a golfer to utilize a proper golf stance.

OBJECTS AND SUMMARY OF THE INVENTION

A general object of the present invention is to provide a new golf stance trainer for assisting a golfer in learning a proper golf stance.

A more specific object of the invention is to provide a golf stance trainer having a unique transducer activated by novel actuation members in response to bodily movements during a golf swing for providing a golfer with feedback regarding the correctness of his stance.

Another object of the present invention is to provide a golf stance trainer for monitoring the maintenance of a proper stance by a golfer during a golf swing.

An additional object of the invention is to provide a golf stance trainer for detecting lateral shifting of a golfer's hips during a golf swing.

A further object of the present invention is to provide a golf stance trainer for detecting extension of the handed knee away from the intended flight of the ball.

Another object of the invention is to provide a golf stance trainer for monitoring a golfer's sliding versus his pivoting during a golf swing.

An additional object of the present invention is to provide a golf stance trainer for providing a golfer with feedback regarding the correctness of his stance during a golf swing.

A further object of the invention is to provide a golf stance trainer which is adjustable for use with golfers of different dimensions.

Another object of the present invention is to provide a golf stance trainer having sensing means for monitoring positioning of at least one of a golfer's buttocks, hips, and handed leg during a golf swing.

An additional object of the invention is to provide a golf stance trainer having an actuation member lockable in a fully retracted position.

A further object of the present invention is to provide a golf stance trainer having locking means for disabling the sensing means.

A golf stance trainer, constructed according to the teachings of the present invention, for monitoring a golfer's stance during a golf swing comprises a superstructure having at least one means for monitoring buttock positioning and movement, means for monitoring hip positioning and movement, and means for monitoring leg positioning and movement during a golf swing.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements in which.

DETAILED DESCRIPTION OF THE PREFERRED EMBODIMENT

Figure 1:
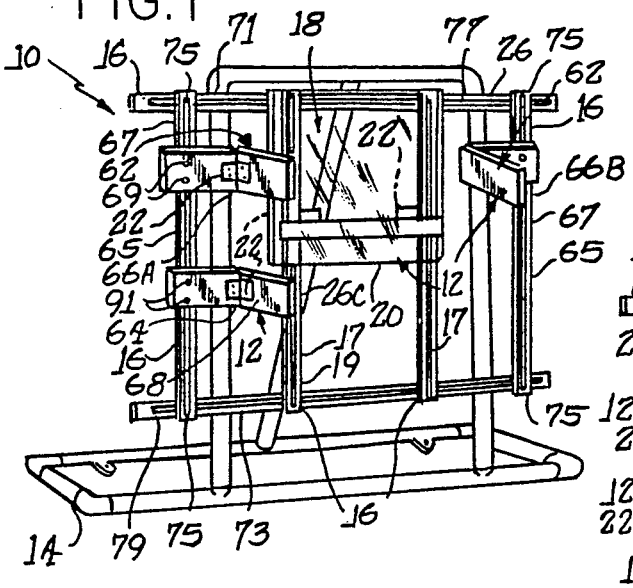
FIG. 1 is a perspective view of a golf stance trainer, constructed according to the teachings of the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
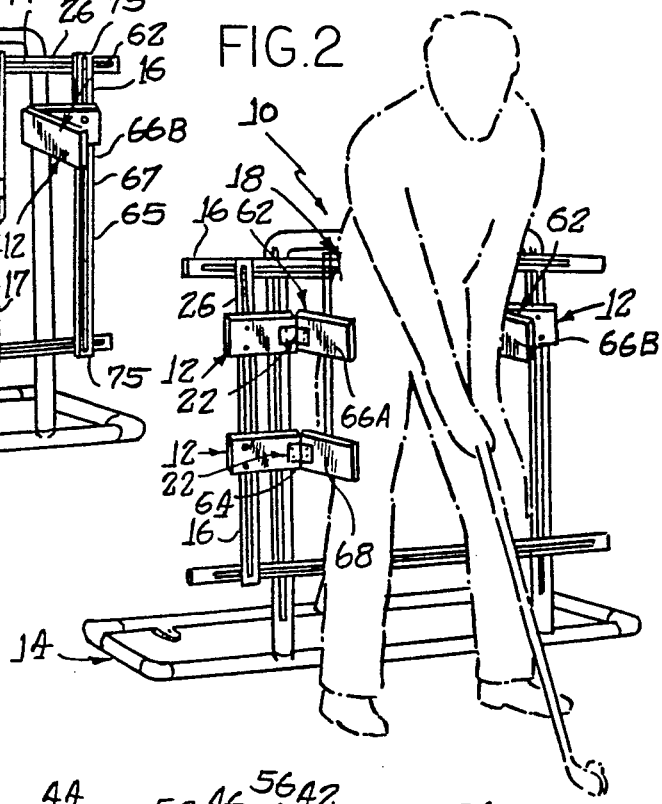
FIG. 2 is a view similar to that of FIG. 1 with a golfer shown in phantom illustrating the relationships between the golf stance trainer and a golfer.

Referring to FIGS. 1 and 2, a golf stance trainer 10, constructed according to the teachings of the present invention, for monitoring a golfer's stance during a golf swing in an effort to teach the golfer a proper stance, is illustrated. Generally, the trainer 10 comprises a plurality of sensor elements 12 responsive to bodily movements of a golfer during a golf swing shiftably mounted on a supporting superstructure 14. The sensor elements 12 are shiftable to allow for golfers of different dimensions. Thus, one trainer 10 can be used with a plurality of golfers.

The superstructure 14 comprises a plurality of support members 16, to some of which are mounted the sensor elements 12. The support members 16 can be formed from wood, plastic, or any other material having sufficient strength to support the sensor elements 12. The support members 16 do not have to be fixedly attached to one another. Specifically, the support members 16 each have a slot 17 therein of dimensions sufficient to accept a removable fastener 19. The slots 17 are elongated such that the fasteners 19, such as screws and wing nuts, and the like, may be fixedly located at any point along the slot 17. This allows for the shifting of the sensor elements 12 stated above, and also allows for easy disassembly of the trainer 10 for transportation.

As shown in FIGS. 1 and 2, there are preferably four sensor elements 12 mounted to the superstructure 14 at various locations. It is to be noted that a greater or a lesser number of sensor elements 12 can be used, depending upon the precise elements of the golfer's stance to be monitored. It is also to be noted that the sensor elements 12 are mounted on the superstructure 14 at positions relative to the parts of the human body whose positions and movements are to be monitored during the golf swing.

In the preferred construction, the trainer 10 has means for monitoring buttock positioning and movement in the form of a buttock sensor 18 for monitoring the positioning and movement of a golfer's buttocks during a golf swing. In this way, the golfer can learn to execute the above-discussed proper golf stance during his swing. The buttock sensor 18 generally comprises an actuation member 20 pivotally attached to a support member 16 of the superstructure 14 by a pair of hinges 22, and a sensor module 24.

The actuation member 20 can be composed of wood, plastic, or other suitable material, and is substantially flat and planar. The member 20 has a contacting side 26 and a hinged side 28. The contacting side is engagable by a golfer's buttocks, as will be discussed herein, and the member 20 is connected to the hinges 22 on the hinged side 28.

Figure 8:
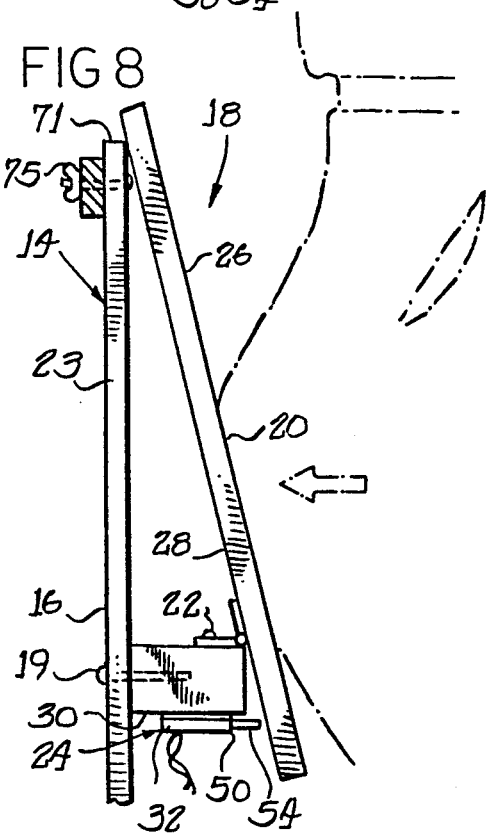
FIG. 8 is a view, similar to that of FIG. 7, with the member moved into a second pivoted position by a golfer's buttocks, thereby deactivating the sensor module.

The member 20 has dimensions sufficient to allow for engagement thereof by differently sized buttocks on different golfers. Preferably, a plurality of hinges 22 is used to properly attach the member 20 to the support member 16. The hinges 22 are located on opposite ends of the member 20 to provide maximum support. The hinges 22 are positioned so that the member 20 can pivot through an arc about the hinges 22 limited by contact between the member 20 and a support member 16, as shown in FIG. 8. Additionally, the support member 16 to which the member 20 is attached allows the member to be shifted vertically to accommodate golfers of different heights. This is accomplished by means of a fastener or screw 19 extending through a vertical slot 21 in an upstanding member 23 of the superstructure.

The sensor module 24 is mounted to the same support member 16 on a side thereof opposite to the hinges 22 by attaching means 30. The attaching means 30 can take on a number of different forms, such as a piece of hook and loop material, an adhesive, a fastener, and the like. Preferably, the attaching means 30 can vary the position of the sensor module 24 on the support member 16 in order to allow for variances present in different golfers.

Figure 3:
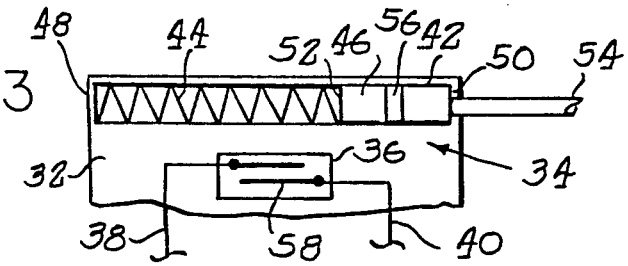
FIG. 3 is a sectional view of a sensor module for use with a golf stance trainer with a movable element in an extended position, thereby opening a reed relay.
Figure 4:
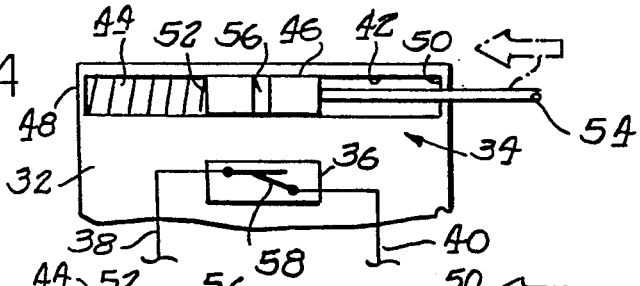
FIG. 4 is a view, similar to that of FIG. 3, with the movable element in a reed relay closing position, thereby energizing a circuit.
Figure 5:
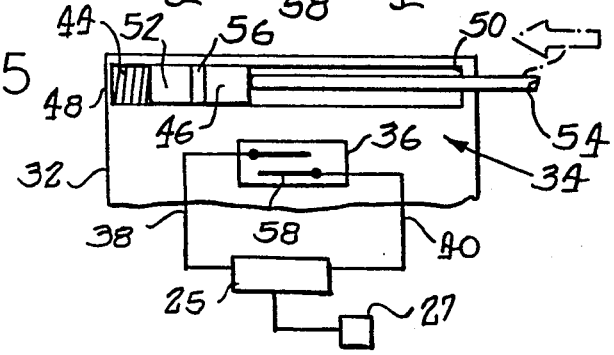
FIG. 5 is a view, similar to that of FIG. 4, with the movable element in a retracted position, thereby opening the reed relay.

The construction of the sensor module 24 is generally illustrated in FIG. 3 through FIG. 5. Specifically, the sensor module 24 comprises a housing 32 containing an electronic circuit 25 having a unique transducer 34 and signaling means comprising an audio signaler 27. The electronic circuit 25 and the signaling means 27 are substantially similar as the corresponding elements disclosed in the co-pending Rilling U.S. patent application of Ser. No. 07/682,569, now U.S. Pat. No. 5,092,601. That patent application is assigned to the assignee of the present invention, and the disclosure of that application is incorporated herein by reference.

The transducer 34 comprises a magnetic reed relay 36 having an input lead 38 and an output lead 40. The transducer 34 also comprises a bore 42 within the housing 32 of dimensions sufficient to accept a spring 44 and a movable element 46. The reed relay 36 is located proximate to the bore 42 for allowing, and the bore 42 has a length sufficient to allow the movable element 46 to be disposed on either side of the reed relay 36 without closing the same. The spring 44 biases the movable element 46 which is capable of longitudinal movement along the bore 42. The reed relay 36 is located within the housing 32 adjacent to the bore 42 approximately midway thereof.

The bore 42 has a closed end 48 and an open end 50 which communicates with the exterior of the housing 32. The movable element 46 has a spring contact portion 52 thereon. The spring 44 is compressible between the closed end 48 of the bore 42 and the contact portion 52 of the movable element 46.

The movable element 46 is connected to a rod 54 on a side thereof opposite to the contact portion 52. The rod 54 extends from the movable element 46 through the open end 50 of the bore 42, and is capable of accepting a force, and applying that force to the movable element 46, causing it to move axially along the bore 42. The rod 54 has a length sufficient so that the rod 54 can extend out of the bore 42 when the spring 44 is fully compressed.

The movable element 46 has a magnet 56 thereon located between the contact portion 52 and the juncture between the movable element 46 and the rod 54. The magnet 56 generates a magnetic field sufficient to attract a switch portion 58 of the reed relay 36 when the magnet 56 is proximate to the reed relay 36. Thus, when the magnet 56 is in the proper position, the magnetic field generated thereby attracts the switch portion 58 and electrically connects the input lead 38 to the output lead 40, completing the circuit. When the circuit is complete, the signaling means 27, such as an audio speaker, is energized, and issues forth a feedback signal to the golfer.

The operation of the sensor module 24 is illustrated sequentially in FIG. 3 through FIG. 5. If no force is applied to the rod 54, the spring 44 exerts a force on the movable element 46 causing it to move along the bore 42 the farthest distance from the closed end 48 to a first position, as shown in FIG. 3. The spring 44 is in an expanded condition, and the magnet 56 is not proximate to the reed relay 36. Thus, the switch portion 58 is in an open position. The circuit is open, and the signaling means is not energized.

When a force of sufficient magnitude is applied to the rod 54, the rod 54 transmits that force to the movable element 46, causing it to move axially along the bore 42 from the open end 50 towards the closed end 48. As the movable element 46 moves, the spring 44 is progressively compressed between the closed end 48 and the spring contact portion 52.

As the magnet 56 nears a second or actuating position along the bore 42 proximate to the reed relay 36, the magnetic field generated thereby influences the switch portion 58. When the magnet 56 is proximate to the reed relay 36, as shown in FIG. 4, the switch portion 58 is attracted by the magnet 56, thereby electrically connecting the input lead 38 with the output lead 40. The electronic circuit is complete, and the signaling means issues forth a feedback signal to the golfer. The signaling means issues feedback until the magnet 56 is moved away from the reed relay 36.

If the force applied to the rod 54 is of sufficient magnitude, the movable element 46 will move further towards the closed end 48 to a third or retracted position, as shown in FIG. 5. The magnet 56 is located away from the reed relay 36, so the switch portion 58 opens the circuit. No feedback signal is issued. At this point, the spring 44 is in a compressed position. If the application of the force to the rod 54 ceases, the movable element 46 moves back towards the open end 50 under the influence of forces generated by the spring 44, producing the above-described effects in reverse order.

Figure 6:
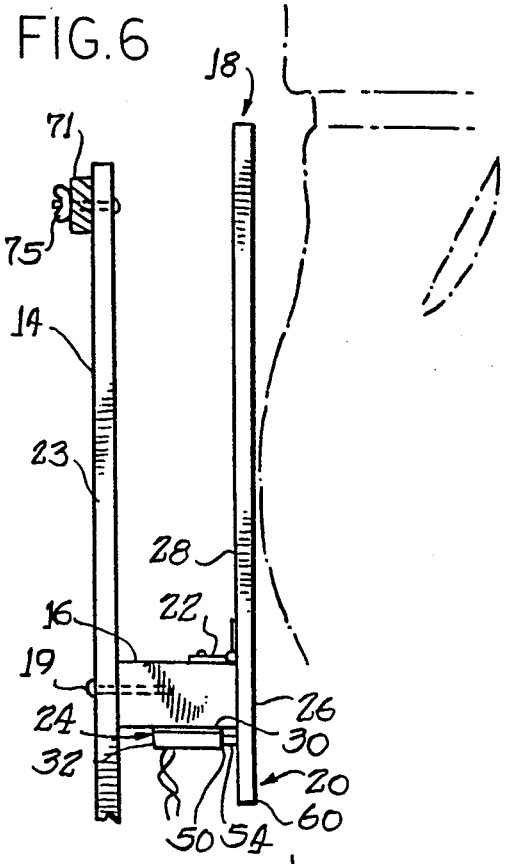
FIG. 6 is a sectional view of an actuating member on the golf stance trainer with the member in a rest position with the sensor module deactivated.

With the structure and operation of the sensor module 24 disclosed, its particular employment with the trainer 10 will now be discussed. The sensor module 24 is mounted on one side of the support member 16 so that the rod 54 extends beyond a terminal end of the support member 16, as shown in FIG. 6. The point of pivotal attachment of the member 20 to the support member 16 defines a lever arm 60 on the member 20. Specifically, the lever arm 60 is that portion of the member 20 which extends beyond the hinges 22 across the side of the support member 16 on which the sensor module 24 is mounted.

Accordingly, the contacting side 28 of the member 20 is capable of engaging and applying a force to the rod 54. In this manner, the pivotal movement of the member 20 about the hinges 22 applies a force to the rod 54, and effects the movement of the movable element 46 along the bore 42. Thus, the pivotal movement of the member 20 activates the transducer 34 and the electronic circuit. And, because the member 20 pivotally moves in response to the positioning and movement of the golfer's buttocks, the golfer will receive feedback indicative of proper positioning of his buttocks in a stance during a golf swing.

It is to be noted, however, that the hinges 22 and/or the member 20 are preferably spring-biased so that the member 20 will be positively moved into a rest position, illustrated in FIG. 6, corresponding to the state of the transducer 34 shown in FIG. 5. The golfer can now take his position in front of the member 20, with his buttocks engaging the same.

Figure 7:
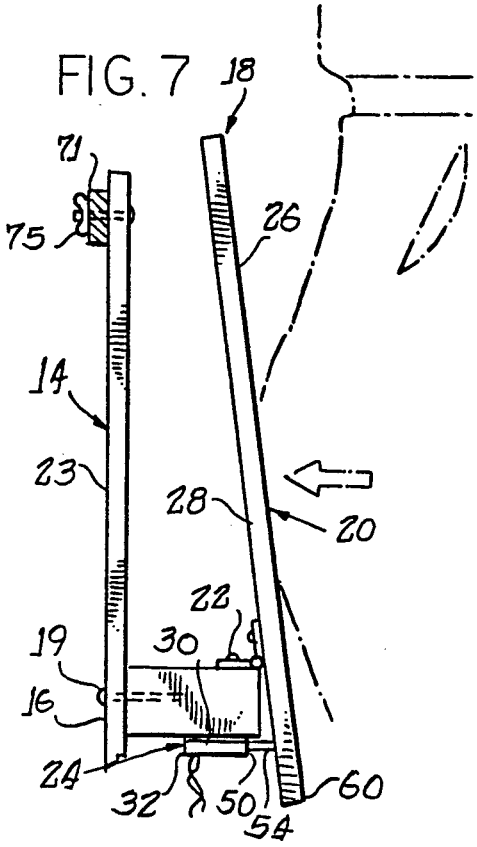
FIG. 7 is a view, similar to that of FIG. 6, with the member moved into a first pivoted position by a golfer's buttocks, thereby activating the sensor module.

The sensor module 24 is positioned so that when the member 20 is insufficiently depressed by the golfer's buttocks, usually in the range of one-quarter to one inch, depending on the particular golfer, the signaling means will be energized and will issue a feedback signal to the golfer, indicating improper buttock positioning. This state is illustrated in FIG. 7. Thus, the transducer 34 is in the state illustrated in FIG. 4.

However, once the golfer has properly positioned his buttocks, depressing the member 20 beyond one inch, depending upon the golfer, no feedback signal will issue, because the transducer 34 will be in the state illustrated in FIG. 3. This indicates proper buttock positioning in a golf stance during a golf swing, and is illustrated in FIG. 8. If this buttock positioning is maintained throughout the golf swing, no feedback signal will issue until the swing is completed.

The buttock sensor 18 monitors the positioning and movement of a golfer's buttocks. But, the positioning and movement of other body parts must also be monitored for a golfer to learn a proper golf stance. In order to provide the golfer with a complete training device, the trainer 10 also has means for monitoring hip positioning and movement in the form of a hip sensor 62, and means for monitoring leg positioning and movement in the form of a leg sensor 64. The construction and operation of the hip sensor 62 and the leg sensor 64 are substantially similar to that of the buttock sensor 18, except for the differences to be noted in the following paragraphs.

The hip sensor 62 is mounted on a vertical or upstanding member 65 of the superstructure 14 at a position offset from the buttock sensor 18, as shown in FIGS. 1 and 2. This is desirable so that the buttock sensor 18 can be contacted by the golfer's buttocks, while the hip sensor 62 can be contacted by the flanks of the golfer's hips. The frame member 65 has an elongated slot 67 through which bolts or other suitable fasteners 69 extend for adjustably securing the sensor 62 at a desired location.

The hip sensor 62 has two actuation members 66A and 66B mounted on opposite sides of and offset downwardly from the buttock sensor 18. The actuation members 66A and 66B are substantially similar to the actuation member 20, but are smaller in dimension. The members 66A and 66B are also pivotally mounted to corresponding support members 16 by spring-biased hinges 22. But, because the members 66A and 66B are smaller than the member 20, only one hinge 22 is required to mount each member 66A and 66B. The upstanding frame members 65 are secured to upper and lower horizontal frame members 71 and 73 by bolts 75 or other fasteners extending through slots 77 and 79 in the frame members 71 and 73 respectively. Thus, the support members 16 and the frame members 65, 71 and 73 to which the members 66A and 66B are mounted allow the members 66A and 66B to be shifted both vertically and horizontally in order to accommodate golfers of various sizes.

The members 66A and 66B are mounted on the support members 16 so that the contacting sides 26A and 26B oppose each other. In this way, the members 66A and 66B can effectively monitor the positioning and movement, or the lateral shift of the golfers hips during a golf swing.

Specifically, the sensor modules 24 associated with each of the members 66A and 66B are positioned so that whenever either member 66A or 66B is pushed away approximately one-half of one inch, depending upon the golfer, from the rest position, a feedback signal will issue. The golfer assumes the proper stance contacting both contacting surfaces 26A and 26B of the members 66A and 66B. If the golfer deviates from that stance during his golf swing, a feedback signal will issue. A signal will also issue if the golfer slides instead of pivoting during his golf swing. Thus the golfer will learn proper hip placement and movement in his stance during a golf swing.

To learn a completely proper golf swing stance, the positioning and movement of the golfer's handed leg must also be monitored. To do this, the leg sensor 64 is provided. The leg sensor 64 is constructed substantially similarly to the hip sensor 62, but the leg sensor 64 comprises only one actuation member 68.

The leg sensor 64 is offset downwardly from the hip sensor 62 so that the contacting side 26C of the member 68 can engage the knee of the golfer's handed leg. The member 68 is pivotally mounted to a support member 16 by a spring biased hinge 22 so that the sensor module 24 associated therewith can respond to movement of the handed leg. The member 68 is mounted on the frame member 65 by bolts 91 extending through slot 67 so that it can be adjusted to accommodate different golfers. The sensor module 24 is mounted on the support member 16 so that any outward movement of the handed leg will cause a feedback signal to issue.

As a golfer uses the trainer 10 he can learn and adopt a more proper golf stance and maintain that stance throughout his golf swing. It is possible that the golfer may learn certain elements of the proper stance before mastering other elements. For instance, the golfer may learn proper proper hip or leg positioning and movement before he learns other movements.

Figure 9:
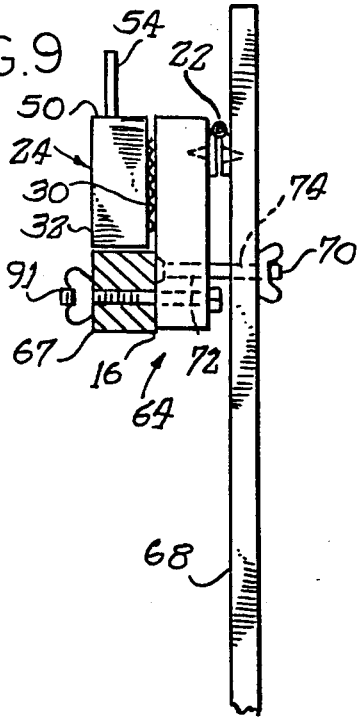
FIG. 9 is a view showing a sensor similar to, but positioned differently from the sensor of FIGS. 6 through 8, and with the member held in a locked position by a fastener.

If this occurs, the golfer may wish to deactivate either or both of the hip and leg sensors. To do this, the golfer may move the member of the respective sensor into its fully retracted position shown in FIG. 9. Once there, locking means in the form of a fastener 70 may be utilized to retain the member, such as member 68, in the retracted position. The fastener 70 is inserted through a hole 72 in the support member 16 and into a corresponding hole 74 in the member. Practice of the proper golf stance with the trainer 10 can allow a golfer to decrease his score, and increase his enjoyment of the game.

While a preferred embodiment of the present invention is shown and described, it is envisioned that those skilled in the art may devise various modifications of the present invention without departing from the spirit and scope of the appended claims. The invention is not intended to be limited by the foregoing disclosure, but only by the following appended claims.

The invention claimed is:

1. A golf stance trainer for monitoring a golfer's stance during a golf swing comprising: a superstructure including a stationary support; at least one of means for monitoring buttock positioning, means for monitoring hip positioning, and means for monitoring leg positioning during a golf swing mounted on said support; the means for monitoring comprising an actuation member mounted by a pivot on the support; the actuation member being pivotable by contact with at least one of a buttock, a hip, and a leg of the golfer; a sensor module for providing the golfer with feedback indicative of body part movement when actuated; and the sensor module being responsive to pivoting of the actuation member a predetermined distance with respect to said stationary support.

2. A golf stance trainer as described in claim 1 wherein the means for monitoring includes a fastener; the support has an elongated slot therethrough for accepting the fastener for attaching at least one of the said means to the support so that at least said one of the means is variably mounted on the superstructure to accommodate golfers of different sizes.

3. A golf stance trainer as described in claim 1 wherein the actuation member is mounted to the support by means of a hinge.

4. A golf stance trainer as described in claim 3 wherein the hinge is spring-biased.

5. A golf stance trainer as described in claim 1 wherein the sensor module comprising a housing having a bore; a movable element axially shiftably disposed within the bore; a rod connected to the movable element and extending from the housing for moving the movable element within the bore in response to pivoting of the actuation member; a magnet movable with the movable element; a magnetic relay disposed within the housing proximate to the bore for completing an electronic circuit for providing the golfer with feedback; and the relay being closable when the magnet is proximate thereto.

6. A golf stance trainer as described in claim 5 further comprising a spring disposed within the bore; and the spring being compressible between between the movable element and the housing for spring-biasing the movable element.

7. A golf stance trainer as described in claim 5 wherein the relay is located proximate to the bore, and the bore has a length sufficient to allow the movable element to be disposed on either side of the relay without closing the same.

8. A golf stance trainer as described in claim 5 wherein the actuation member has a lever arm engagable with the the rod for axially moving the movable element.

9. A golf stance trainer as described in claim 1 which includes all of said monitoring means for respectively monitoring the buttock, the hip, and the leg of a golfer.

10. A golf stance trainer as described in claim 1 further comprising locking means for disabling at least one of the monitoring means.

11. A golf stance trainer as described in claim 1 further comprising locking means for retaining the actuation member in a fully retracted position whereat the member will not be engaged by the body part.

12. A golf stance trainer as defined in claim 1 wherein the superstructure comprises a plurality of said support members; and the support members are shiftable to adjust monitoring means disposition to accommodate golfers of various sizes.

13. A golf stance trainer as described in claim 1 further comprising signaling means actuable by one of the aforementioned means for providing the golfer with feedback indicative of body part positioning.

14. A golf stance trainer as described in claim 13 wherein the signaling means comprises an audio signaler.

15. A golf stance trainer comprising: a superstructure including a plurality of supports; means for monitoring buttock positioning and movement including a buttock sensing member and a pivot structure pivotally interconnecting the member and one of said supports for pivotal movement of the member about a substantially horizontal axis; the member presenting a portion for engagement by a golfer's buttock when the golfer assumes a golf stance; and signaling means responsive to a pivoting of the member a predetermined distance for providing feedback to a golfer in the event of the member pivoting said predetermined distance during a golf swing.

16. A golf stance trainer defined in claim 15 which includes a second monitoring means including a second sensing member and a pivot structure pivotally interconnecting said last mentioned member and a support for pivotal movement of the second member about a substantially vertical axis; the second member being positioned for engagement with one of a hip and a leg of a golfer upon predetermined movement of one of the hip and leg during a golf swing; and second signaling means responsive to the second member for providing feedback to a golfer in the event of said last mentioned predetermined movement.

* * * * *